US005555966A

United States Patent [19]

Tod

[11] Patent Number: 5,555,966

[45] Date of Patent: Sep. 17, 1996

[54] DEVICE FOR THE RECEIVING OF COINS AT A COIN-OPERATED AUTOMATIC MACHINE

[75] Inventor: Tim Tod, Wohnsitz, Scotland

[73] Assignee: Dynamics Chinatec Systemtechnik GmbH, Hamburg, Germany

[21] Appl. No.: 286,633

[22] Filed: Aug. 5, 1994

[30] Foreign Application Priority Data

Aug. 6, 1993 [DE] Germany ..... 43 26 303.8

[51] Int. Cl.[6] ..... G07D 1/00

[52] U.S. Cl. ..... 194/343; 453/57

[58] Field of Search ..... 194/342, 343; 453/32, 34, 49, 57, 56; 221/186, 254, 263

[56] References Cited

U.S. PATENT DOCUMENTS

| | | | |
|---|---|---|---|
| 3,942,541 | 3/1976 | Dupuy | 453/56 |
| 5,082,100 | 1/1992 | Guynonneam | 194/343 |
| 5,122,094 | 6/1992 | Abe | 453/57 |
| 5,190,495 | 3/1993 | Taxon | 453/57 X |

FOREIGN PATENT DOCUMENTS

| | | | |
|---|---|---|---|
| 0080842 | 11/1982 | European Pat. Off. | G07D 1/00 |
| 0501607 | 1/1992 | European Pat. Off. | G07D 9/00 |
| 2643849 | 3/1978 | Germany | B65G 47/14 |
| 3-123990 | 5/1991 | Japan | 194/343 |

*Primary Examiner*—F. J. Bartuska
*Attorney, Agent, or Firm*—Horst M. Kasper

[57] ABSTRACT

A device for the receiving of coins in a coin-operated automatic machine is provided with a coin-insertion slot, furnished in the coin-operated automatic machine for receiving of the coin money, where the individual coins have to be fed successively by the user. The device allows the receiving of coins such that the complete mixture of coins is accepted and is automatically and sequentially individually fed to the coin acceptance tester. In order to achieve an automatic continuous coin feed to the coin acceptance tester, there is provided a continuous conveyor with a coin collection space, where the coins, which can be fed in as mixed coins, are individualized and then fed to the coin acceptance tester.

22 Claims, 4 Drawing Sheets

DEVICE FOR THE RECEIVING OF COINS AT A COIN-OPERATED AUTOMATIC MACHINE

BACKGROUND OF THE INVENTION

1. Field of the Invention

The invention refers to a device for the receiving of coins at a coin-operated automatic machine with a coin-insertion slot on a front plate, wherein a coin channel follows to the coin-insertion slot on the rear side of the front plate and leads to a coin-receiving station of a coin tester.

2. Brief Description of the Background of the Invention Including Prior Art

A coin output device with a continuous conveyor loop is known from the European Printed Patent Document EP 80,842-B1. The conveyor loop is formed by a plurality of chain links. The chain links are hingedly connected to each other. The chain links exhibit webs by way of which the coins can be transported from a coin storage container to a coin-output opening. The webs are inclined in the direction of the output opening of a coin output device. However, it is a disadvantage in this construction that a coin storage space, coordinated in the coin output device, can be charged exclusively from the top.

The company, NRI National Rejectors, Inc. GmbH, discloses coin testers in its flier entitled "NRI Zusammenstellungsplan G-18". The brochure "Merkur-Service, adp-Technik" contains on pages 297–305 an article entitled "Der mechanische Münzprüfer" (Mechanical coin tester) and describing the functioning of mechanical coin testers G-06.2000/G-07.3000.

The coin testers of the company, NRI National Rejectors, Inc. GmbH, are described in the publication AUTOMATEN MARKT, Issue May 1991, pages 144–150, and Issue June 1991, pages 162–165 in an article entitled "Müsnzprüfer gestern und heute" (Coin Testers today and yesterday).

Coin testers are also known from the fact sheets of the company, Coin Controls International, entitled "C 200 Serie".

SUMMARY OF THE INVENTION

1. Purposes of the Invention

It is an object of the present invention to improve the coin output device of the state of the art such that the coin output device is formed to accept mixed coins in order to convey individualized coins to a coin acceptance tester.

It is another object of the present invention to provide a device for receiving coins which reduces the possibilities of jamming a single input.

It is yet a further object of the present invention to simplify operation of a coin-operated automatic machine by allowing the machine to accept not yet individualized coins.

These and other objects and advantages of the present invention will become evident from the description which follows.

2. Brief Description of the Invention

According to the present invention, there is provided for a device for receiving coins at a coin-operated automatic machine. A coin-insertion slot is formed in the front plate. A coin channel is disposed following to the coin-insertion slot on a rear side of the front plate. An opening is disposed in the front plate for receiving a mixture of coins. A continuous conveyor is connected to the coin opening for receiving the mixture of coins for providing a coin collection space for the mixture of coins and is connected to the coin channel to allow transport of individualized coins from the continuous conveyor to the coin channel. A coin acceptance tester includes a coin receiving station and is connected to the coin channel such that coins, delivered from the coin channel, are lead to the coin-receiving station of the coin acceptance tester.

The continuous conveyor can include a hollow cylinder forming a transporting agent. Catch webs can be disposed rotation symmetrically relative to a rotation axis of the hollow cylinder and disposed on an inner face of the hollow cylinder. There can be provided a casing rear wall part of the continuous conveyor. An output opening can be disposed in the casing rear wall part. The catch webs can be inclined in a direction of the output opening.

Nose-shaped projections can be disposed at an inner circumference of the hollow cylinder. The nose-shaped projections can be located in the area of a coin-feed side of the continuous conveyor.

An endless tooth structure gearing can be disposed at a front face along the circumference of the hollow cylinder directed toward the casing rear wall part. A drive motor can be attached to the casing rear wall part. A drive pinion can be fixedly attached to a shaft of the drive motor for engaging endless toothing.

Extensions can be disposed on the casing rear wall part. Said extensions can be directed in the direction of the casing front part. The hollow cylinder can be lapped over in axial direction by the extensions. A form-matching and force-locking structure can be furnished on a rear side wall of the casing rear wall part disposed opposite to the extensions. A support can be provided for supporting the drive pinion and can be furnished on the casing rear wall part disposed opposite to the extensions. The form-matching and force-locking structure and the support for supporting the drive pinion can form a receiver device for supporting the drive motor of the hollow cylinder.

A breakout can be furnished in the region of the extensions in the casing rear wall part, where the drive pinion in part penetrates the breakout.

A first circular ring-shaped web of the casing front part can be attached to the rear side of the casing front part. An inner circumference of the circular ring-shaped web of the casing front part can support the hollow cylinder. A circular ring-shaped web forming a guide collar of the casing rear wall part can be attached to the front side of the casing rear wall part. An outer periphery of the circular ring-shaped web of the casing rear wall part supports the hollow cylinder.

A coin output opening can be furnished in the casing rear wall part. The coin output opening can be coordinated to an inner circumference of the hollow cylinder. The coin output opening can be disposed substantially symmetrically relative to a horizontal rotation axis of the hollow cylinder.

Preferably, a wall region of the casing rear wall part is coverable by the hollow cylinder and is shaped like a truncated cone.

A throughput sensor for capturing passing coins and for delivering corresponding signals can be disposed at the coin channel, leading from the coin-insertion slot and from the coin output opening to the coin acceptance tester. A control unit can be connected to the throughput sensor. The control unit can control a drive motor. The control unit can be constructed for stopping the drive motor for a predetermined, adjustable time interval after each passage of coins.

A sensor adapted to determine a presence of a coin can be disposed in conjunction with the hollow cylinder for determining if coins are present in the hollow cylinder.

A control unit can be connected to the sensor, adapted to determine a presence of a coin and furnishing power to the control unit in case a coin is stored and present in the hollow cylinder until the predetermined time interval has elapsed.

A device for receiving coins at a coin-operated automatic machine includes a coin opening disposed in the front plate for receiving a mixture of coins. A continuous conveyor is connected to the coin opening for receiving the mixture of coins for providing a coin collection space for the mixture of coins. A coin channel is connected to the continuous conveyor to allow transport of individualized coins from the continuous conveyor to the coin channel. A coin acceptance tester is connected to the coin channel.

A coin-insertion slot can be formed in the front plate. A second coin channel can lead to the coin-receiving station of the coin acceptance tester and follow to the coin-insertion slot on a rear side of the front plate.

The invention device is associated with the advantage that the coin money, required for operating a coin-operated automatic machine, can be fed in a simple way to the coin collection space based on a handle-type, shell-like structure of a covering of a side opening of a coin collection space for the coin money. The coins are individualized and separated from each other on the continuous conveyor and are subsequently fed to the sequentially disposed coin acceptance tester or coin acceptance checker. In case of a failure of the continuous conveyor, it is in addition possible to feed coins to the coin tester through the neighboring coin-insertion slot in order to be able to operate the automatic machine and in order to benefit in this way from the services or goods delivered by the automatic machine. The invention device is constructed such that coins and tokens of different sizes and within a common size range can be processed without any particular setting or adjustment. In order to decrease the susceptibility to interference in such devices, the conventional coin insertion slot is additionally provided.

The individualization of the coins occurs through the rotation of the hollow cylinder, where the hollow cylinder exhibits at its inner circumference the catch webs, and wherein the catch webs have such a height and dimension that in each case only one coin can rest on one of said webs. The coin is being transported from a low position in the hollow cylinder to the slot level represented by a coin output opening in the casing rear wall part, where the slot and coin output opening is disposed laterally above the horizontal line of the hollow cylinder. The coin output opening is a slot elongated in a vertical direction. When the hollow cylinder is rotated and the coin in the hollow cylinder passes the coin output opening, the coin rolls automatically into said opening based on the catch webs of the hollow cylinder, which catch webs are disposed inclined toward the casing rear wall part, and then the coin is transported through the coin channel to the subsequent coin acceptance tester.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
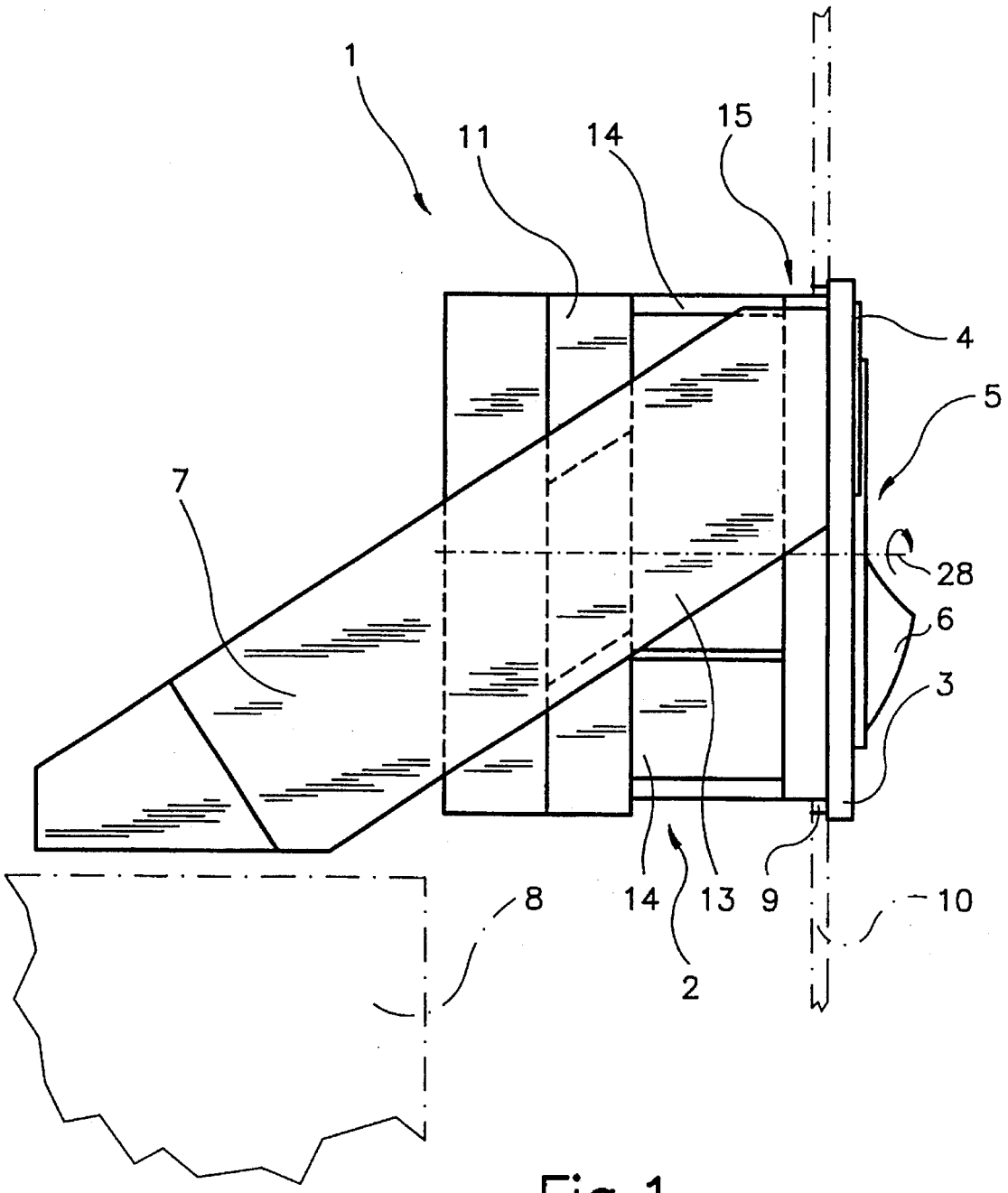
FIG. 1 is a side elevational view of the device with a continuous conveyor and a coin channel leading to a coin testing device.

According to the present invention, there is provided for a device for receiving coins at a coin-operated automatic machine with a coin-insertion slot 4 on a casing front part 3. A coin channel 7, leading to a coin-receiving station of a coin acceptance tester 8, follows to the coin-insertion slot 4 for feeding a single coin and disposed on a rear side of the casing front part 3. An opening 5 is disposed neighboring to the coin-insertion slot 4 for purposes of feeding mixed money to a coin collection space of a continuous conveyor 2, where individualized coins are feedable from the coin collection space to a coin acceptance tester 8 through an intermediary of the coin channel 7.

The continuous conveyor 2 can include as a transporting agent a hollow cylinder 13. The hollow cylinder 13 can exhibit on its inner circumference catch webs 25 disposed parallel to each other. The catch webs 25 can be inclined in a direction of an output opening 20 in the casing rear wall part 11 of the continuous conveyor 2.

The hollow cylinder 13 can exhibit at the inner circumference nose-shaped projections 26 in the area of a coin-feed side of the continuous conveyor 2.

A front face of the hollow cylinder 13, directed toward the casing rear wall part 11, can exhibit an endless toothing 18 on its circumference. A drive pinion 17 of a drive motor 12 can comb the endless toothing 18.

The casing rear wall part 11 can exhibit extensions 14 directed in the direction of the casing front part 3. The hollow cylinder 13 can be lapped over in axial direction by the extensions 14. A receiver device for the drive motor 12 of the hollow cylinder 13 can be furnished on a side wall of the casing rear wall part 11 disposed opposite to the extensions 14. The receiver device can be formed by a support of the drive pinion 17 and by a form-matching and force-locking structure of the rear side 23 of the casing rear wall part 11.

A breakout 24 can be furnished in the region of the extensions 14 in the casing rear wall part 11. The breakout 24 can be penetrated in part by the drive pinion 17.

The hollow cylinder 13 can be supported, on the one hand, on an inner circumference of a circular ring-shaped web 21 of the casing front part 3 and, on the other hand, on an outer periphery of a circular ring-shaped web 22 of the casing rear wall part 11.

A coin output opening 20 can be furnished in the casing rear wall part 11. Said coin output opening 20 can be coordinated to the inner circumference of the hollow cylinder 13. The coin output opening 20 can be disposed approximately symmetrically relative to the horizontal rotation axis 28 of the hollow cylinder 13.

A wall region 19 of the casing rear wall part 11 can be covered by the hollow cylinder 13 and can be formed like a truncated cone.

At least one throughput sensor 27 for capturing passing coins can be coordinated to the coin channel 7, leading from the coin-insertion slot 4 and from the coin output opening 20 to the coin acceptance tester 8. The throughput sensor 27 can be connected to a control unit 29, where a controlling of the drive motor 12 can be performed by the control unit 29. The drive motor 12 can be stopped for a predetermined, adjustable time interval after each passage of coins.

It can be determined with at least one presence sensor 35 if coins are present in the hollow cylinder 13.

The drive motor 12 can be powered by the control unit 29 in case a coin storage is present in the hollow cylinder 13 until the predetermined time interval has elapsed.

A device 1 illustrated in FIG. 1 comprises a continuous conveyor 2 with a casing front part as a front plate 3, which includes a coin-insertion slot 4 as well as an opening 5 with a covering formed as a handle-type, shell-like structure, serving as a front insertion shell 6. A coin channel 7 follows to the coin-insertion slot 4. The coin channel 7 ends at a coin feed opening of a coin acceptance tester 8 indicated with a dash-dotted line.

The coin channel 7 exhibits a width which is only slightly larger than the thickness of a coin 32. It can be assured in this way that the coin 32 rolls in the coin channel in the direction of the coin acceptance tester 8, even in case the coin channel exhibits only a very small slope.

The continuous conveyor 2 includes the casing front part 3, a casing rear wall part 11, and a hollow cylinder 13. The casing front part 3 covers a breakout 9 on the front side 10 of an automatic machine, indicated with dash-dotted lines. A drive motor 12 is disposed at the rear side in the casing rear wall part 11. The casing rear wall part 11 is furnished with extensions 14 on the front side. The extensions 14 are substantially disposed on a cylindrically shaped surface having an axis perpendicular to the casing rear wall part 11. Preferably from about 3 to 8 extensions are provided such as, for example, 4 extensions. The width of the extensions can be from about 360/n×0.2 to 360/n×0.7, and preferably from about 360/n×0.4 to 360/n×0.5.

Four web-like formed extensions 14 extending in the direction of the casing front part 3 are disposed uniformly at the circumference of the casing rear wall part 11. The extensions 14 exhibit at their free ends 15 form-matching and force-locking connection elements, with which the extensions 14 are attachable to the casing front part 3. The hollow cylinder 13 is lapped over by the extensions 14 in an axial direction of the hollow cylinder 13. The extensions 14 embrace in part the hollow cylinder 13 and extend over the width of the hollow cylinder 13.

The rear wall part 11 is further furnished with a guide collar 22 for guiding the rotation of the hollow cylinder around an axis defined by the guide collar 22 and common to the hollow cylinder 13. The catch webs 25 of the inner section of the hollow cylinder 13 are furnished with guide edges 39 for guiding coins which passed from the front insertion shell into the hollow cylinder 13.

The hollow cylinder 13, driven by the drive motor 12, is disposed horizontal and rotatable around its rotation axis 28 between the casing front part 3 and the casing rear wall part 11. The hollow cylinder 11 exhibits a horizontal rotation axis 28 and is located with the cylinder defined extensions 14. The horizontal rotation axis 28 of the hollow cylinder 13 extends in the paper plane starting from the casing front part 3 up to the casing rear wall part 11.

The casing front part 3 exhibits the coin-insertion slot 4 and the front insertion shell 6, which is formed like a handle shell and which covers in part an approximately circular-shaped opening 5 in the lower region.

Figure 2:
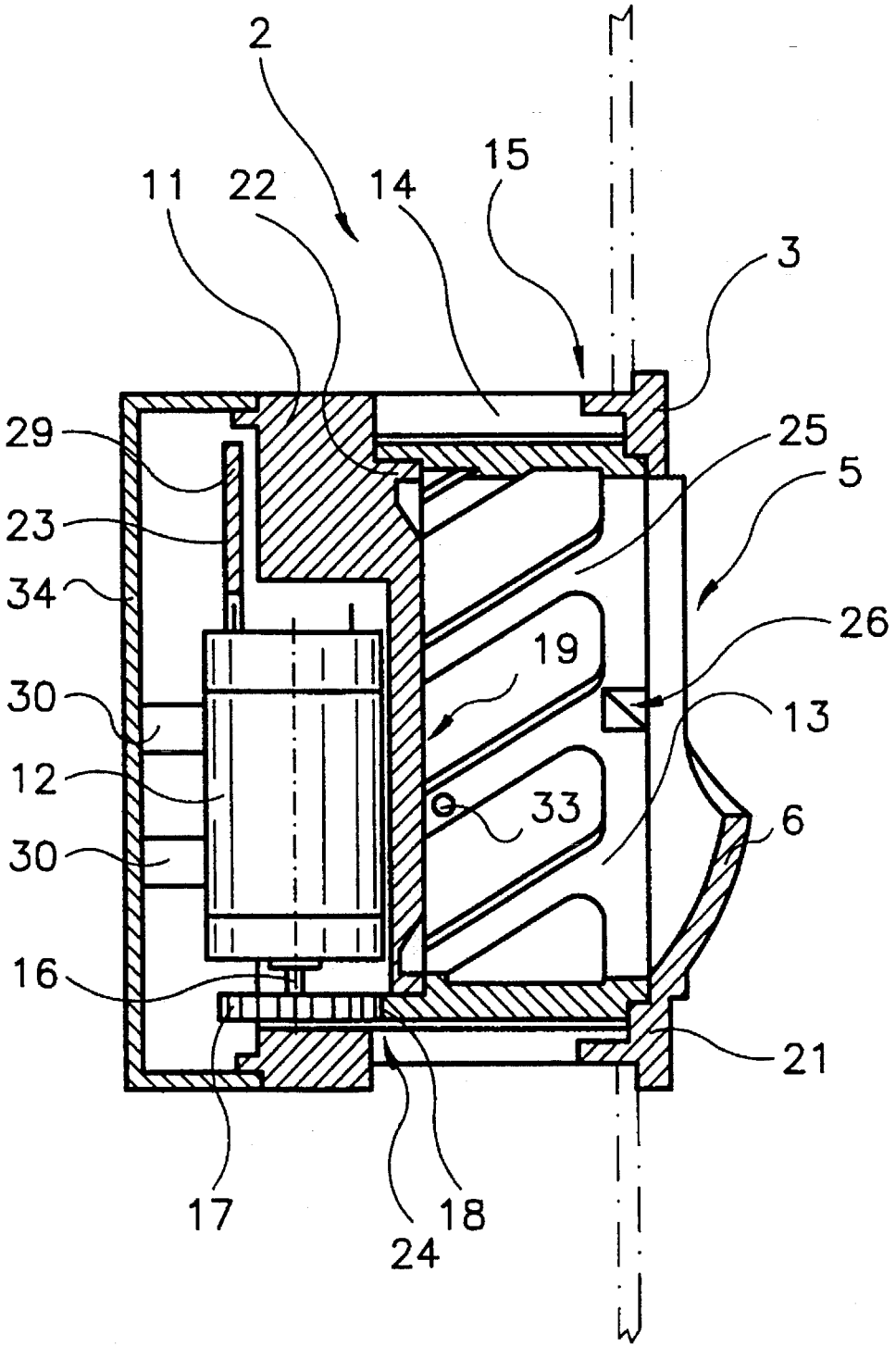
FIG. 2 is a sectional view through the device of FIG. 1.

A receiver device or receiver compartment for the drive motor 12 is disposed on the rear side of the casing rear wall part 11. The receiver device for the motor 12 is formed, on the one hand, by the support of the drive pinion 17 and, on the other hand, by a form-matching and force-locking and preferably molded form compartment in the rear side 23 of the casing rear wall part 11. The cover 34 can be mounted to the casing rear wall part 11 and exhibits two rubber-like knubs 30 at its inner side facing the motor, as shown in FIG. 2. The drive motor 12 is fixed in its position at the inner side of the cover 34 of the casing rear wall part 11 by the two knubs 30. The knubs 30 are preferably made of an elastic material such as rubber or plastic. They contact and engage the casing of the motor 12 thereby damping vibrations of the motor casing and feeding the dampened vibrations to the cover 34. A drive pinion 17 is solidly and fixedly attached on a drive shaft 16 of the drive motor 12 such that the drive pinion 17 is fixed against rotation relative to the drive shaft 16. The drive pinion 17 penetrates a breakout 24 of the casing rear wall part 11 in the direction toward the hollow cylinder 13. The hollow cylinder 13 exhibits an endless toothing 18 on the circumference of the face of the cylinder directed toward the casing rear wall part 11. The drive pinion 17 combs and engages in the toothing 18 of the hollow cylinder 13 such that the hollow cylinder is rotated by the motor 12 through the drive pinion 17. The wall region 19 of the casing rear wall part 11, facing the casing front part 3 and covered by the hollow cylinder 13, is formed substantially like a frustrum of a truncated cone and projects into the hollow cylinder 13. The wall region 19 exhibits the shape of a truncated cone in order to avoid that coins 32, standing on their respective narrow edges, dispose themselves extending with their width in a radial direction in the hollow cylinder 13 but instead rest on the inner wall of the hollow cylinder 13. The interaction of the inner surface of the hollow cylinder 13, sloping toward the wall region 19, and of the truncated cone has the result that the coin 32, standing on its narrow edge, tends to tilt in the direction of the front insertion shell 6 based on the inclined running inner surface of the hollow cylinder 13 and based on the absence of a lateral support in the lower region of the coin 32.

The coin channel 7, leading from the coin-insertion slot 4, and the coin channel 31, leading from the coin output opening 20 of the casing rear wall part 11 toward the coin-acceptance tester, exhibit at least one throughput sensor 27 for the recognition of a passage of a coin 32. The throughput sensor 27 is connected to a control unit or printed circuit board 29, not illustrated in detail. The drive motor 12 is powered from the printed circuit board 29.

In a conventional sensor, a photodiode is employed as light source and a light-sensitive diode is employed as a receiver, where the diodes are disposed opposite to each other. Sensors for the recognition of a passage of a coin are known from the German Printed Patent Document DE 2,648,183 C2.

The type of control unit depends on the type of installation in which the invention device is being employed. The invention device can, for example, be employed in an automatic ticket vending machine, where the control unit is furnished by a microprocessor system. In this case the ticket price is to be selected. The key actuation for the selection of the ticket price actuates the power of the drive motor of the invention device. The control unit of the automatic ticket vending machine determines, with the aid of the sensors 27, disposed in the coin channels 7, 31, and with the aid of the output signals of the coin acceptance tester 8, whether the whole ticket price has been paid. If the complete ticket price has not been paid within a predetermined time period, then the current to the motor 12 of the invention device is interrupted and the already deposited coins are returned.

Figure 5:
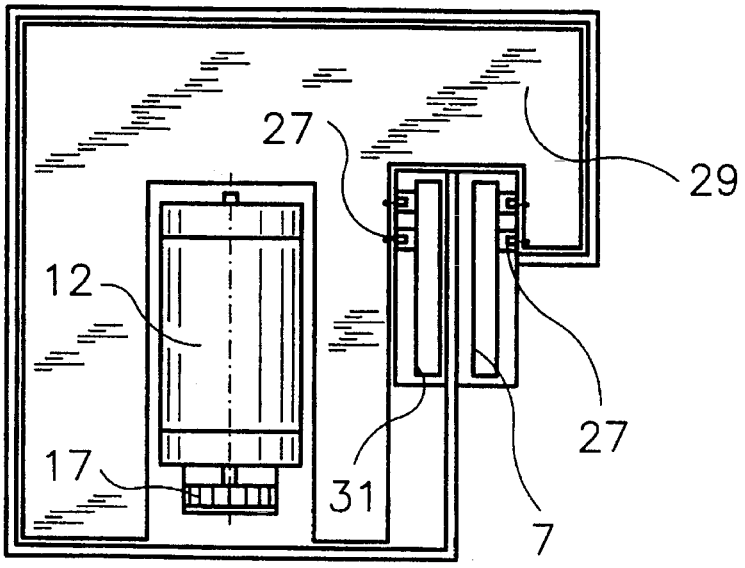
FIG. 5 is a rear elevational view of the device with the rear cover removed.

As can be gathered from the exemplified embodiment of the present invention illustrated on FIG. 5, the throughput sensor 27 includes two photodiodes, employed as light sources, and two corresponding light-sensitive diodes, employed as receivers. In each case, one photodiode and one light-sensitive diode is disposed adjoining the coin channels 7 and 31, respectively.

The continuous conveyor 2 is illustrated in the longitudinal section in FIG. 2. The casing front part 3 exhibits a nearly circular opening 5. The front insertion shell 6, which is formed like a handle shell, is coordinated to the lower region of the opening 5. The casing front part 3 exhibits on its rear side a circular ring-shaped web 21, disposed concentrically relative to the opening 5. The extensions 14 of the casing rear wall part 11 are form-matchingly and force-lockingly attached at the outer circumference of the web 21. The hollow cylinder 13 is supported on its outer circumference at the inner circumference of the circular ring-shaped web 21 of the casing front part 3. The hollow cylinder 13 is supported on the wall of the casing rear wall part 11, facing the casing front part 3, at the inner circumference of a circular ring-shaped web forming a guide collar 22 providing a defined position for the rotation of the hollow cylinder.

A device or compartment for a receiving of the drive motor 12 is furnished on the rear side 23 of the casing rear wall part 11. A breakout 24 is provided in the casing rear wall part 11 in the region of the front face of the hollow cylinder 13. The breakout 24 is penetrated by a drive pinion 17 of the drive motor 12. The drive pinion 17 combs in the gear wheel-like formed front face of the hollow cylinder 13.

The printed circuit board 29 for providing the electronic circuitry required for the operation of the coin separator is provided at the rear side of the casing rear wall part 11. The printed circuit bard is connected to a power source, to the motor, and to the respective sensors employed.

At least one sensor 35 for determining a presence of a coin in the hollow cylinder 13 is disposed in the wall region 19, formed like a truncated cone, of the casing rear wall part 11. It is recognized with the sensor 35 if coins 32 are present in the hollow cylinder 13. The sensor 35 is connected with the printed circuit board 29, not illustrated in detail.

Figure 3:
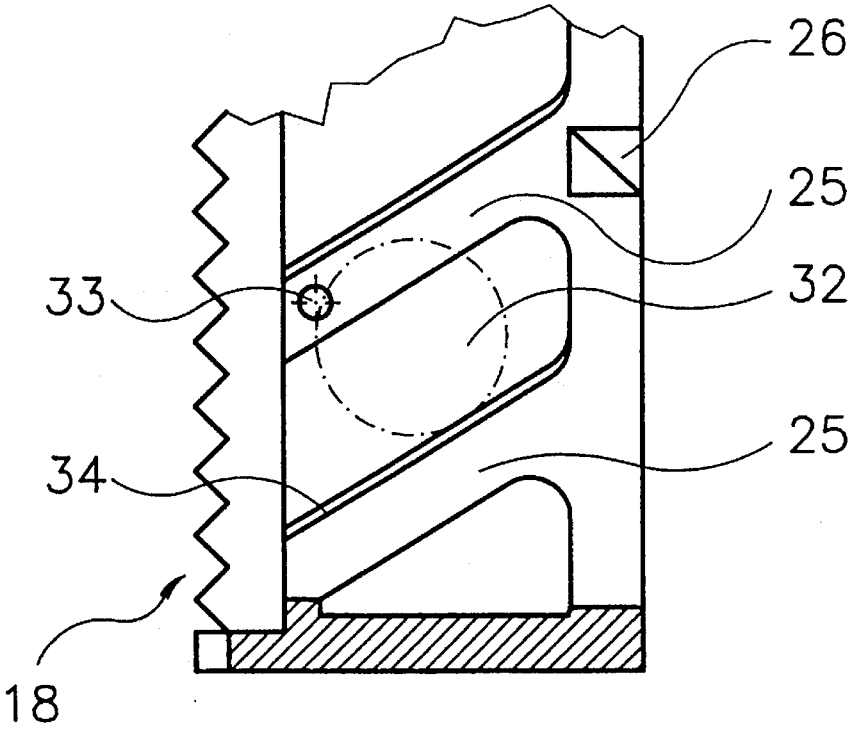
FIG. 3 is a sectional detail view of the embodiment of FIG. 2 through the hollow cylinder of the continuous conveyor.
Figure 6:
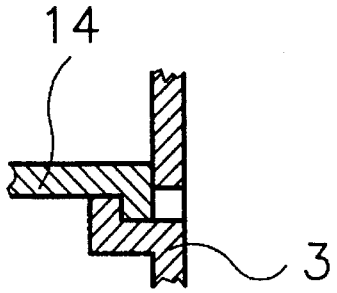
FIG. 6 is a cross-sectional view of a snap closure of the casing front part to the extension of the casing rear wall part.
Figure 4:
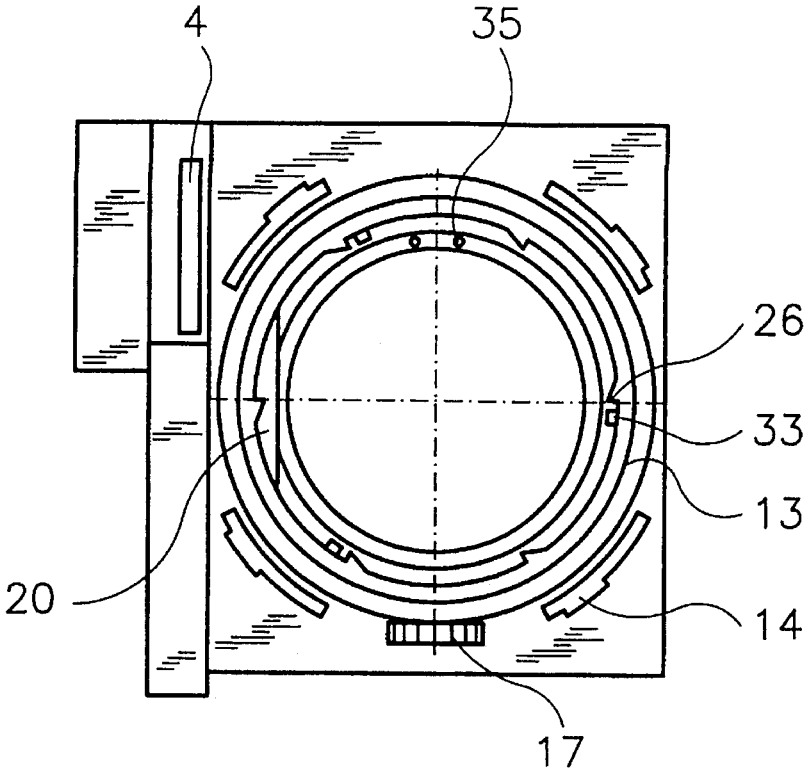
FIG. 4 is a front elevational view of the device with the front cover removed.

The hollow cylinder 13 is shown in FIG. 3 in a longitudinal sectional view. The hollow cylinder 13 exhibits catch webs 25 at its inner circumference. The catch webs 25 are disposed uniformly at the circumference of the hollow cylinder 11. The catch webs 25 are formed as straight lines in the hollow cylinder 13, and the catch webs 25 are disposed rotation symmetrically relative to the axis 28 of the hollow cylinder 13. The hollow cylinder 13 exhibits on its side facing the casing front part 3 at least a nose-shaped projection 26, or coin-deflection burls or knobs. It can be gathered from FIG. 4 that six nose-shaped projections 26 are disposed uniformly over the circumference of the hollow cylinder 13.

The catch webs 25 are disposed inclined at the horizontal axis 28 at an angle of about 10° to 40° and preferably 15° to 25° such as 20° for shifting the coins within a peripheral plane of the hollow cylinder 13 such that the coin 32, disposed on the catch webs 25, automatically moves toward the coin-output opening 20 disposed in the casing rear wall part 11, where the coin-output opening 20 is furnished on the side of the wall region 19, formed like a truncated cone, of the casing rear wall part 11. Furthermore, three cylindrical pins 33 are disposed at the inner circumference of the hollow cylinder 3. It is the object of the cylindrical pins 33 to separate coins which are disposed above one another and have become wedged in a heap in the interior of the hollow cylinder 13.

The hollow cylinder 13 is illustrated in the longitudinal section in FIG. 3. The hollow cylinder 13 exhibits an endless toothing 18 on the circumference of its front face. The catch webs 25 are distributed uniformly on the inner wall of the hollow cylinder. In particular, the catch webs 25 are disposed inclined and rotary symmetric relative to the rotation axis of the hollow cylinder 13 inner circumference. The inclination angle of the catch webs 25, extending in the longitudinal direction of the hollow cylinder, is selected such that the coins 32 are automatically moving in the direction of the coin-output opening 20 in the frustrated cone-like formed wall region 19 of the casing rear wall part 11. Preferably, the angle of the catch webs 25 is from about 20° to 45° in a vertical plane relative to a horizontal line. At least one web with a nose-shaped projection 26 is furnished on the hollow cylinder section facing the casing front part 3.

Coins 32 are fed through the side opening 5 of the coin-collection space of the continuous conveyor, where the side opening 5 is covered in part by the handle shell 6. The sensor 35, coordinated to the coin-collection space, recognizes that a mixed money coin storage is present in the hollow cylinder 13. The power for the drive motor 12 is fed by the control unit or printed circuit board 29. The hollow cylinder 13 is rotated in a clockwise direction. The coins 32 are transported by the catch webs 25, disposed at the inner circumference of the hollow cylinder 13, in a vertical direction and upwardly by the rotating hollow cylinder 13. During the transport, the coin 32 rolls on the inclined catch webs 25 in the direction of the wall region 19 of the casing rear wall part 11 to the coin-output opening 20. Depending on the construction of the apparatus, a single coin channel 7 or a dual coin channel 7, 31 can be provided. In case of a dual coin channel, one coin channel is associated with coins entered into the coin-insertion slot and a second coin channel is associated with coins entered through the front insertion shell 6. The coin 32 penetrates the coin-output opening 20 and is fed through the coin channel 31 in case of a dual channel and, respectively, through the channel 7 in case of a single channel following to the coin-output opening 20, to the coin acceptance tester 8. A throughput sensor 27 is activated when the coin 32 passes through the coin channel 7 and/or, respectively, 31. After actuation of the throughput sensor 27 associated with the channel 7, 31, the drive motor 12 is stopped for a predetermined adjustable time period.

The channels 7 and 31 are separated by a metal plate. Otherwise, the components of the invention structure are preferably made of a moldable plastic material, where the parts can be joined by respective locks where appropriate. Thus, the coin separator can be formed of essentially five molded plastic parts: the front insertion shell 5, the hollow cylinder 13, the casing rear wall part 11, the cover 34, and the coin channels 7, 31. Such construction allows production of the separator of relatively economic molded plastic parts.

It is prevented with this construction that coins follow each other too quickly into the coin acceptance tester, thereby causing a clogging of the coin acceptance tester, based on the intermediate stoppage of the drive motor 12. This can occur in particular in cases where mixed money is fed to the coin-collection space of the continuous conveyor 2 at the same time as when coins are inserted through the neighboring coin-insertion slot 4.

It will be understood that each of the elements described above, or two or more together, may also find a useful application in other types of coin-operated game devices differing from the types described above.

While the invention has been illustrated and described as embodied in the context of a coin-operated automatic machine, it is not intended to be limited to the details shown, since various modification and structural changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for receiving coins at a coin-operated automatic machine comprising a front plate;

a coin-insertion slot formed in the front plate;

a coin channel disposed following to the coin-insertion slot on a rear side of the front plate;

a coin opening disposed in the front plate for receiving a mixture of coins;

a continuous conveyor including a hollow cylinder forming a transporting agent and connected to the coin opening for receiving the mixture of coins for providing a coin collection space for the mixture of coins and connected to the coin channel to allow transport of individualized coins from the continuous conveyor to the coin channel; catch webs disposed rotation symmetrically relative to a rotation axis of the hollow cylinder and disposed on an inner face of the hollow cylinder;

a coin acceptance tester including a coin receiving station and connected to the coin channel such that coins, delivered from the coin channel, are led to the coil-receiving station of the coin acceptance tester, a casing rear wall part of the continuous conveyor; an output opening in the casing rear wall part, wherein the catch webs are inclined in a direction of the output opening.

2. The device according to claim 1, further comprising nose-shaped projections disposed at an inner circumference of the hollow cylinder, wherein the nose-shaped projections are located in the area of a coin-feed side of the continuous conveyor.

3. The device according to claim 1, further comprising an endless tooth structure gearing disposed at a front face along the circumference of the hollow cylinder directed toward the casing rear wall part;

a drive motor attached to the casing rear wall part;

a drive pinion fixedly attached to a shaft of the drive motor for engaging endless toothing.

4. The device according to claim 3, further comprising extensions disposed on the casing rear wall part, wherein said extensions are directed in the direction of the front plate, and wherein the hollow cylinder is lapped over in axial direction by the extensions;

a form-matching and force-locking structure furnished on a rear side wall of the casing rear wall part disposed opposite to the extensions;

a support for supporting the drive pinion and furnished on the casing rear wall part disposed opposite to the extensions, wherein the form-matching and force-locking structure and the support for supporting the drive pinion form a receiver device for supporting the drive motor of the hollow cylinder.

5. The device according to claim 4, further comprising a breakout furnished in the region of the extensions in the casing rear wall part, where the drive pinion in part penetrates the breakout.

6. The device according to claim 1, further comprising a first circular ring-shaped web of the front plate attached to the rear side of the front plate, wherein an inner circumference of the circular ring-shaped web of the front plate supports the hollow cylinder;

a circular ring-shaped web forming a guide collar of the casing rear wall part attached to the front side of the casing rear wall part, wherein an outer periphery of the circular ring-shaped web of the casing rear wall part supports the hollow cylinder.

7. The device according to claim 1, further comprising a coin output opening furnished in the casing rear wall part, wherein the coin output opening is coordinated to an inner circumference of the hollow cylinder, and wherein the coin output opening is disposed substantially symmetrically relative to a horizontal rotation axis of the hollow cylinder.

8. The device according to claim 1, wherein a wall region of the casing rear wall part is coverable by the hollow cylinder and is shaped like a truncated cone.

9. The device according to claim 7, further comprising a throughput sensor for capturing passing coins and for delivering corresponding signals is disposed at the coin channel, leading from the coin-insertion slot and from the coin output opening to the coin acceptance tester; a control unit connected to the throughput sensor, wherein the control unit controls a drive motor, and wherein the control unit is constructed for stopping the drive motor for a predetermined, adjustable time interval after each passage of coins.

10. The device according to claim 1, further comprising a sensor adapted to determine a presence of a coin disposed in conjunction with the hollow cylinder for determining if coins are present in the hollow cylinder.

11. The device according to claim 10, further comprising a control unit connected to the sensor adapted to determine a presence of a coin and furnishing power to the control unit in case a coin is stored and present in the hollow cylinder until the predetermined time interval has elapsed.

12. A device for receiving coins at a coin-operated automatic machine with a coin-insertion slot (4) on a casing front part (3), wherein a coin channel (7), leading to a coin-receiving station of a coin acceptance tester (8), follows to the coin-insertion slot (4) on a rear side of the casing front part (3), wherein an opening (5) is disposed adjacent to the coin-insertion slot (4), wherein a continuous conveyor, having a coin collection space and having inclined steps for guiding the coins, is disposed following to the opening, and wherein mixed money is fed to the coin collection space of the continuous conveyor (2), where individualized coins are feedable from the coin collection space to a coin acceptance tester (8) through an intermediary of the coin channel (7), wherein the continuous conveyor (2) includes a hollow cylinder (13) as a transporting agent, where the hollow cylinder (13) exhibits on its inner circumference catch webs (25) disposed parallel to each other, where the catch webs (25) are inclined in a direction of an output opening (20) in a casing rear wall part (11) of the continuous conveyor (2).

13. The device according to claim 12, wherein the hollow cylinder (13) exhibits nose-shaped projections (26) at the inner circumference in the area of a coin-feed side of the continuous conveyor (2).

14. The device according to claim 12, wherein a front face of the hollow cylinder (13), directed toward the casing rear wall part (11), exhibits an endless toothing (18) on its circumference, where a drive pinion (17) of a drive motor (12) combs the endless toothing (18).

15. The device according to claim 14, wherein the casing rear wall part (11) exhibits extensions (14) oriented in the direction of the casing front part (3), wherein the hollow cylinder (13) is lapped over in axial direction by the extensions (14), wherein a receiver device for the drive motor (12) of the hollow cylinder (13) is furnished on a side wall of the casing rear wall part (11) disposed opposite to the extensions (14), and wherein the receiver device is formed by a support of the drive pinion (17) and by a form-matching and force-locking structure of the rear side (23) of the casing rear wall part (11).

16. The device according to claim 15, wherein a breakout (24) is furnished in the region of the extensions (14) in the casing rear wall part (11), where the breakout (24) is penetrated in part by the drive pinion (17).

17. The device according to claim 12, wherein the hollow cylinder (13) is supported, on the one hand, on an inner circumference of a circular ring-shaped web (21) of the casing front part (3) and, on the other hand, on an outer periphery of a circular ring-shaped web (22) of the casing rear wall part (11).

18. The device according to claim 12, wherein a coin output opening (20) is furnished in the casing rear wall part (11), which coin output opening (20) is coordinated to the inner circumference of the hollow cylinder (13), and wherein the coin output opening (20) is disposed approximately symmetrically relative to the horizontal rotation axis (28) of the hollow cylinder (13).

19. The device according to claim 12, wherein a wall region (19) of the casing rear wall part (11) is coverable by the hollow cylinder (13) and is formed like a truncated cone.

20. The device according to claim 18, wherein at least one throughput sensor (27) for capturing passing coins is coordinated to the coin channel (7), leading from the coin-insertion slot (4) and from the coin output opening (20) to the coin acceptance tester (8), wherein the throughput sensor (27) is connected to a control unit (29), where controlling of a drive motor (12) is performed by the control unit (29), and wherein the drive motor (12) is stoppable for a predetermined, adjustable time interval after each passage of coins.

21. The device according to claim 14, wherein it can be determined with at least one presence sensor (35) if coins are present in the hollow cylinder (13).

22. The device according to claim 21, wherein the drive motor (12) is powered by the control unit (29) in case a coin storage is present in the hollow cylinder (13) until the predetermined time interval has elapsed.

* * * * *